US007254865B2

(12) United States Patent
Bosses

(10) Patent No.: US 7,254,865 B2
(45) **Date of Patent: *Aug. 14, 2007**

(54) VACUUM BAG GUIDE WITH TELESCOPIC NOZZLE

(76) Inventor: Mark D. Bosses, 505 NE. Spanish Trail, Boca Raton, FL (US) 33432

( * ) Notice: Subject to any disclaimer, the term of this patent is extended or adjusted under 35 U.S.C. 154(b) by 3 days.

This patent is subject to a terminal disclaimer.

(21) Appl. No.: 11/346,865

(22) Filed: Feb. 1, 2006

(65) Prior Publication Data

US 2007/0074494 A1 Apr. 5, 2007

Related U.S. Application Data

(63) Continuation-in-part of application No. 11/240,168, filed on Sep. 30, 2005.

(51) Int. Cl.
*A47L 5/00* (2006.01)

(52) U.S. Cl. ..... 15/327.2; 15/347; 15/351; 55/373; 55/374; 55/DIG. 2

(58) Field of Classification Search ..... None
See application file for complete search history.

(56) References Cited

U.S. PATENT DOCUMENTS 4,452,618 A * 6/1984 Kuplas ..... 55/362
4,936,883 A * 6/1990 Larsson et al. ..... 55/374
5,028,245 A * 7/1991 Stein et al. ..... 55/373
5,089,038 A 2/1992 Kopco et al.
5,544,385 A 8/1996 Jailor et al.
5,755,009 A 5/1998 Stephens et al.
5,766,283 A * 6/1998 Bumb et al. ..... 55/367
5,970,575 A 10/1999 Lee
6,033,451 A 3/2000 Fish et al.
6,277,165 B1 8/2001 Lovett et al.
6,381,804 B1 5/2002 Paterson et al.
6,442,793 B1 9/2002 Paterson et al.
6,451,078 B2 9/2002 Berfield et al.
6,502,274 B1 1/2003 Harrelson, II
6,560,816 B1 5/2003 Harrelson, II
6,733,555 B1 5/2004 Wilder
2001/0005983 A1 7/2001 Berfield et al.
2003/0200620 A1 * 10/2003 Dobson et al. ..... 15/351
2004/0045119 A1 3/2004 Ponjican et al.

* cited by examiner

*Primary Examiner*—David Redding
(74) *Attorney, Agent, or Firm*—Amster, Rothstein & Ebenstein LLP

(57) ABSTRACT

A vacuum bag mounting assembly for housing a vacuum bag within a vacuum cleaner, where the vacuum cleaner comprises a vacuum intake nozzle having an outlet end portion through which sucked in dirt is delivered to the vacuum bag mounting assembly, including a vacuum bag collar receiver that engages a collar of the vacuum bag, a telescopic nozzle end attached to the outlet end portion, the telescopic nozzle end being moveable along the outlet end portion towards and away from the collar of the vacuum bag, and a nozzle engagement member pivotally attached to the vacuum bag collar receiver. The nozzle engagement member is attached to the telescopic nozzle end such that pivoting of the nozzle engagement member in a first direction results in movement of the telescopic nozzle end away from the collar of the vacuum bag and pivoting of the nozzle engagement member in a second direction results in movement of the telescopic nozzle end towards the collar of the vacuum bag.

11 Claims, 12 Drawing Sheets

SIDE VIEW

SECTION THRU COVER LATCH

SHOWING LATCH AND NOZZLE FORK MOTION

SECTION through telescopic nozzle lever assy

SECTION through telescopic nozzle lever assy

SECTION through telescopic nozzle lever assy

SECTION through telescopic nozzle lever assy

SECTION through telescopic nozzle lever assy

VACUUM BAG GUIDE WITH TELESCOPIC NOZZLE

RELATED APPLICATION

The present application is a continuation-in-part of co-pending U.S. patent application Ser. No. 11/240,168, filed Sep. 30, 2005, the contents of which are incorporated herein by reference.

TECHNICAL FIELD

The present invention relates to vacuum cleaners and, more particularly, to vacuum cleaners having removable vacuum bags.

BACKGROUND

Conventional vacuum cleaners use fabric or paper bags to capture the dirt and dust picked up by the vacuum cleaner. The process of changing the filter bag is frequently rather difficult and complicated. Past attempts at simplifying the vacuum bag replacement process have included the use of a mounting plate that pivots about a hinge. For example, U.S. Pat. No. 5,089,038 discloses the use of a rectangular mounting plate including a channel that receives a collar of a dust bag. The mounting plate includes a pivot pin which is received within a hinge barrel attached to an inner wall of a vacuum cleaner housing. The pivot pin and hinge barrel allow the mounting plate to pivot to an open position in which the collar can be inserted into or removed from the channel and to a closed position in which the collar is disposed in contact with a vacuum hose. A latch means on the mounting plate is used to latch the mounting plate onto the side of the housing opposite the pivot pin.

The mounting assembly disclosed in the '038 Patent, and other similar mounting assemblies using a hinged mounting plate, are disadvantageous in that they require the vacuum cleaner to have a larger and bulkier construction to allow room for the mounting plate to pivot. Also, the pivoting mounting plate constructions typically require that the mounting plate be latched on or snap-fit into a housing assembly after the vacuum bag is replaced, which adds to the overall complexity of the vacuum bag replacement procedure. In this regard, if the mounting plate is not properly latched on or snap-fit into the vacuum bag housing assembly, the mounting plate may pivot into an open position during use of the vacuum cleaner, thereby disconnecting the vacuum bag from the vacuum hose and allowing dust and dirt particles to scatter throughout the housing assembly. This is particularly problematic in that any free dust or dirt may become lodged in the vacuum cleaner motor or be released back onto the carpet. Further, prior vacuum bag replacement procedures using the hinged mounting plate structure have required the user to operate "in the blind", in that the user does not have a full view inside the housing assembly to ensure that the mounting plate is properly placed in position.

Accordingly, there is a need for a vacuum bag mounting assembly that allows for easy replacement of vacuum bags and a more compact and light-weight overall vacuum cleaner design.

SUMMARY OF THE INVENTION

A vacuum bag mounting assembly according to an exemplary embodiment of the invention for housing a vacuum bag within a vacuum cleaner, where the vacuum cleaner comprises a vacuum intake nozzle having an outlet end portion through which sucked in dirt is delivered to the vacuum bag mounting assembly, includes a vacuum bag collar receiver disposed within the vacuum bag storage compartment that engages a collar of the vacuum bag, a telescopic nozzle end attached to the outlet end portion, the telescopic nozzle end being moveable along the outlet end portion towards and away from the collar of the vacuum bag, and a nozzle engagement member pivotally attached to the vacuum bag collar receiver. The nozzle engagement member is attached to the telescopic nozzle end such that pivoting of the nozzle engagement member in a first direction results in movement of the telescopic nozzle end away from the collar of the vacuum bag and pivoting of the nozzle engagement member in a second direction results in movement of the telescopic nozzle end towards the collar of the vacuum bag.

A vacuum cleaner according to an exemplary embodiment of the invention includes a vacuum nozzle head, a handle for maneuvering the vacuum cleaner, a vacuum bag mounting assembly for housing a vacuum bag, and a vacuum intake nozzle having an outlet end portion through which sucked in dirt is delivered to the vacuum bag housing assembly. The vacuum bag mounting assembly includes a vacuum bag collar receiver that engages a collar of the vacuum bag, a telescopic nozzle end attached to the outlet end portion of the vacuum intake nozzle, the telescopic nozzle end being moveable along the outlet end portion towards and away from the collar of the vacuum bag, and a nozzle engagement member pivotally attached to the vacuum bag collar receiver. The nozzle engagement member is attached to the telescopic nozzle end such that pivoting of the nozzle engagement member in a first direction results in movement of the telescopic nozzle end away from the collar of the vacuum bag and pivoting of the nozzle engagement member in a second direction results in movement of the telescopic nozzle end towards the collar of the vacuum bag.

In at least one embodiment, the vacuum bag mounting assembly further includes a latch member. The latch member includes a first end pivotally attached to the nozzle engagement member, a second end frictionally engaged with a bottom wall of the vacuum bag collar receiver; and a torsion spring that provides a spring force that biases the latch mechanism in a vertical position, wherein the vacuum bag collar contacts the second end of the latch member as the vacuum bag collar is inserted into the vacuum bag collar receiver to thereby urge the latch member against the spring force such that the nozzle engagement member is pivoted in the second direction.

These and other features of this invention are described in, or are apparent from, the following detailed description of various exemplary embodiments of this invention.

BRIEF DESCRIPTION OF THE DRAWINGS

Various exemplary embodiments of this invention will be described in detail, with reference to the following figures, wherein.

DETAILED DESCRIPTION OF PREFERRED EMBODIMENTS

Figure 1:
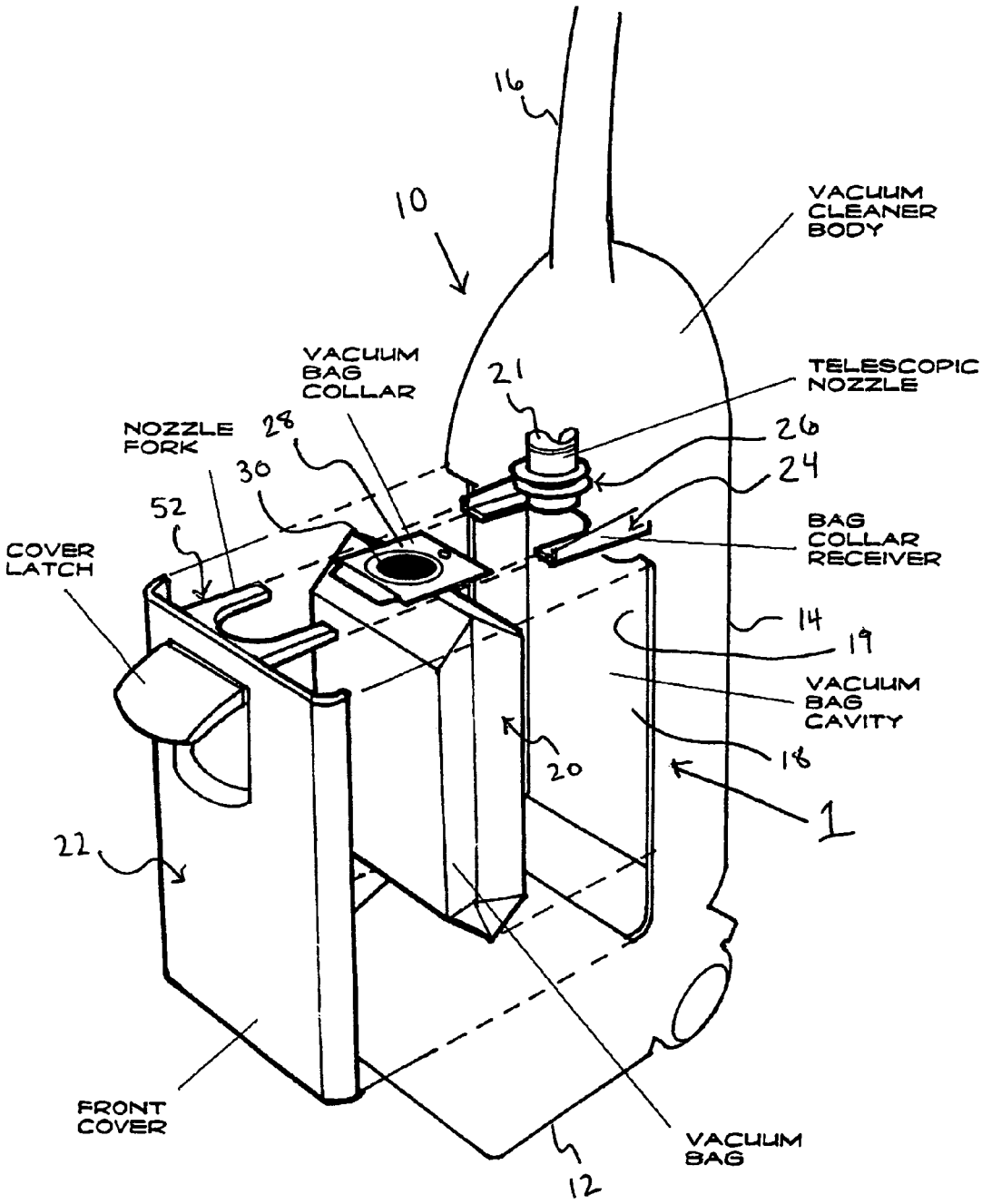
FIG. 1 is an exploded view of a vacuum bag mounting assembly according to an exemplary embodiment of the invention.

FIG. 1 is an exploded view of a vacuum bag mounting assembly 1 according to an exemplary embodiment of the invention constructed as part of a vacuum cleaner 10. The vacuum cleaner 10 includes generally a vacuum nozzle head 12, a vertically extending main body 14 and a handle 16 extending from the upper portion of the main body 14. The mounting assembly 1 includes a vacuum bag storage compartment 18 disposed within the base 14 for storing a removable vacuum bag 20. A vacuum intake nozzle 21, in communication with the vacuum nozzle head 12 opens into the storage compartment 18. The mounting assembly 1 also includes a housing cover 22 that covers the storage compartment 18, a stationary bag collar receiver 24 that extends outwardly from the back wall 19 of the storage compartment 18 and a telescopic nozzle end 26 that is extendable from the vacuum intake nozzle 21. The housing cover 22 may be removable or hinged to the main body to allow for access to the storage compartment 18. As explained in more detail below, the housing cover 22, the bag collar receiver 24 and the telescopic nozzle end 26 cooperate with one another to hold the vacuum bag 20 in an upright position within the storage compartment 18.

The vacuum bag 20 includes a collar 28 formed at one end, with a collar opening 30 for attachment to the telescopic nozzle end 26. A rubber gasket 32 may be disposed around the circumference of the collar opening 30, so that a tight seal is formed between the telescopic nozzle end 26 and the collar opening 30. As is known in the art, the collar 28 may be made of a flat rectangular or square-shaped cardboard piece.

Figure 2:
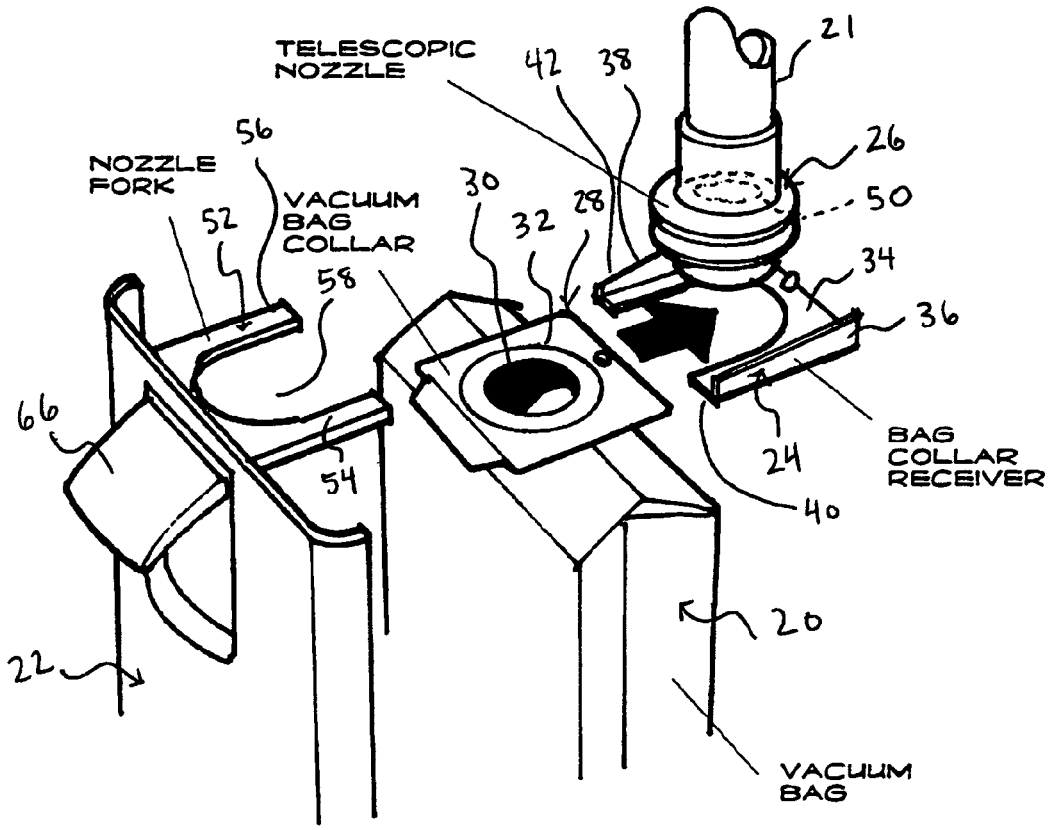
FIG. 2 shows a vacuum bag being placed into the vacuum bag housing assembly of FIG. 1.

As shown in FIG. 2, the bag collar receiver 24 includes a horizontally extending bottom wall 34, a vertically extending first side wall 36 and a vertically extending second side wall 38. A U-shaped opening 35 is formed in the bottom wall 34 so that the bag collar receiver 24 forms a fork shaped structure having a first prong 40, made up of the bottom wall 34 and the first side wall 36, and a second prong 42, made up of the bottom wall 34 and the second side wall 38.

Figure 3:
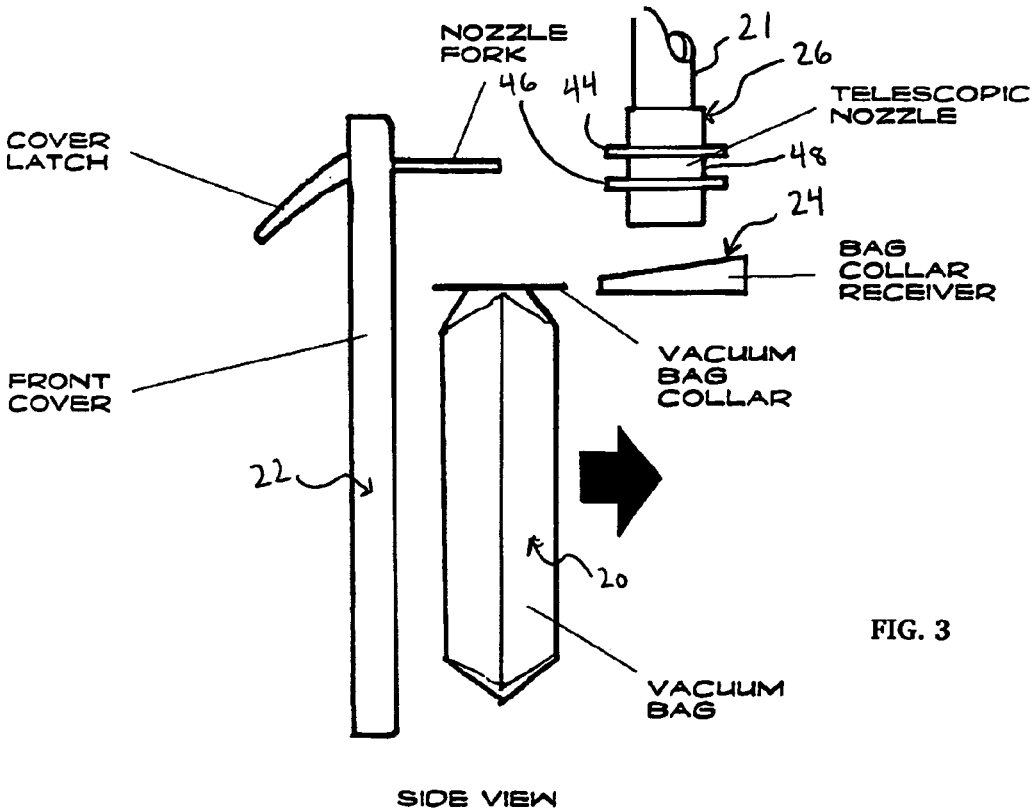
FIG. 3 is a profile view of a vacuum bag being placed into the vacuum bag housing assembly of FIG. 1.

As shown in FIGS. 2 and 3, to place the vacuum bag 20 into the vacuum bag storage compartment 18, the vacuum bag collar 28 is slid into the bag collar receiver 24 such that the first prong 40 and the second prong 42 are disposed underneath the sides of the vacuum bag collar 28. In this position, the collar opening 30 is positioned directly below and in line with the telescopic nozzle end 26 of the vacuum intake nozzle 21.

As shown in FIG. 3, the inner circumference of the telescopic nozzle end 26 is slightly larger than the outer circumference of the vacuum intake nozzle 21, so that the telescopic nozzle end 26 can be placed over and extend from the end of the vacuum intake nozzle 21 with a friction fit. This allows the telescopic nozzle end 26 to be moved vertically up and down along the vacuum intake nozzle 21 so as to effectively lengthen or shorten the vacuum intake nozzle 21. Alternatively, the outer circumference of the telescopic nozzle end 26 may be slightly smaller than the inner circumference of the vacuum intake nozzle 21, so that the telescopic nozzle end 26 can be placed within and extend from the end of the vacuum intake nozzle 21 with a friction fit. The telescopic nozzle end 26 includes an upper flange 44 and a lower flange 46. The upper and lower flanges 44, 46 form a circumferential groove 48 in the telescopic nozzle end 26. In at least one embodiment, the telescopic nozzle end 26 includes an inner flange 50, which contacts the end of the vacuum intake nozzle 21 to prevent the telescopic nozzle end 26 from being pushed over the vacuum intake nozzle 21 beyond a certain point. In an exemplary embodiment of the invention, the telescopic nozzle end 26 may be biased in the up position by a spring or other mechanism.

Figure 10:
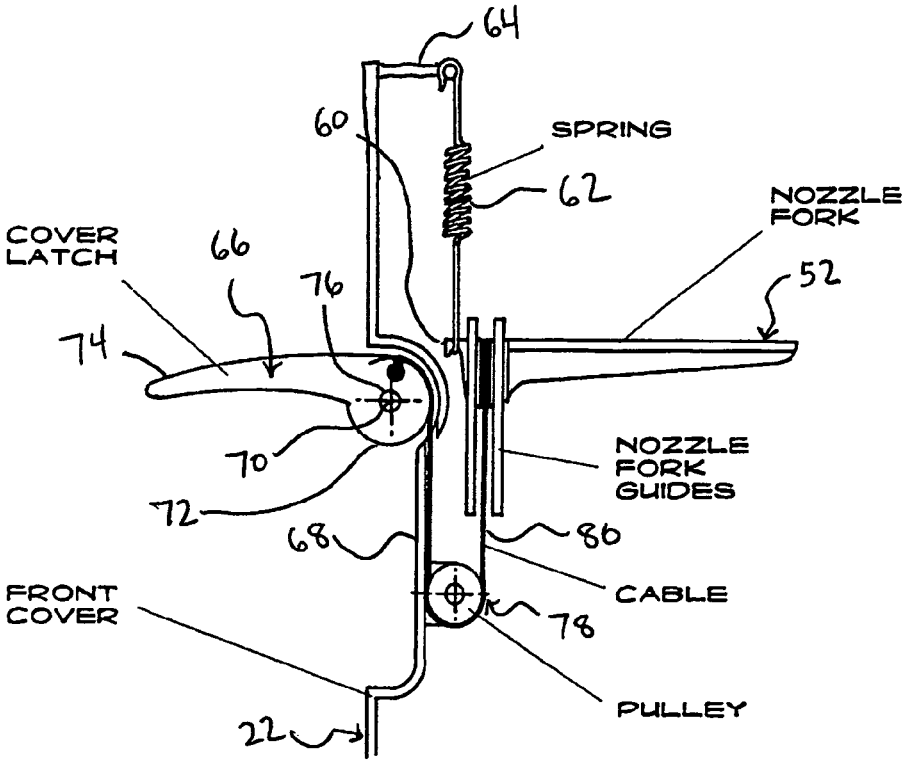
FIGS. 10 and 11 are detailed profile views of a cover latch being pivoted downwards to engage a telescopic nozzle of the vacuum bag housing assembly of FIG. 1.
Figure 11:
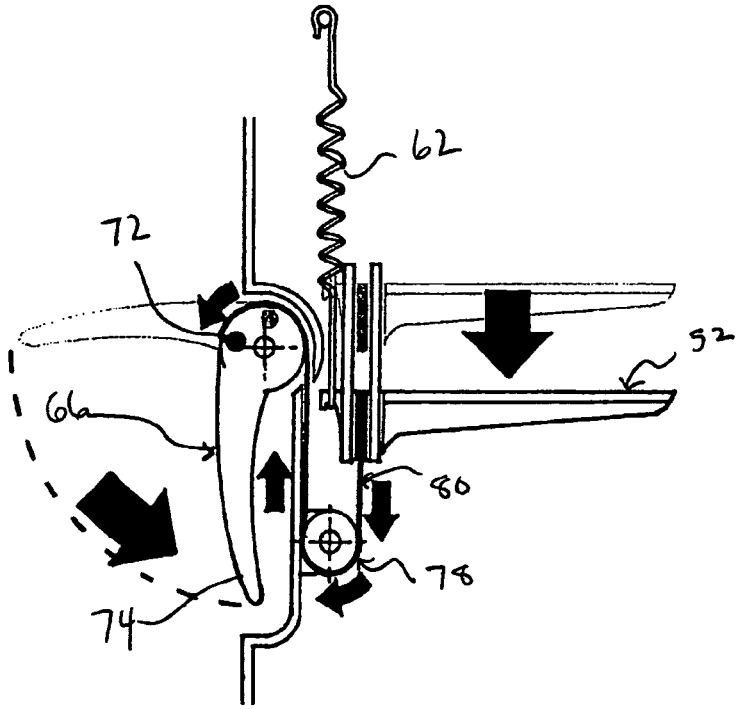

As shown in FIGS. 1-3, a nozzle fork 52 extends horizontally from the upper portion of the inside surface of the housing cover 22. The nozzle fork 52 includes a first nozzle fork prong 54 and a second nozzle fork prong 56. The first and second nozzle fork prongs 54, 56 form a U-shaped opening 58 in the nozzle fork 52. As shown in FIGS. 10 and 11, a spring hook 60 is disposed at the back portion of the nozzle fork 52. One end of a vertically extending spring 62 is attached to the spring hook 60. The other end of the spring 62 is fixed to a spring support 64 that extends horizontally from the inside surface of the housing cover 22 above the nozzle fork 52. The spring 62 biases the nozzle fork 52 upwards. As explained in more detail below, a cover latch 66 disposed on the outer surface of the housing cover 22 may be used to pull the nozzle fork 52 downwards against the upwards bias of the spring 62.

The housing cover 22 includes an indented portion 68 and a pivot rod 70 that extends horizontally across the upper portion of the indented portion 68. The cover latch 66 includes a cam portion 72 and a handle portion 74. A bore 76 extends horizontally through the cam portion 72. The pivot rod 70 extends through the bore 76 of the cam portion 72, so that the cover latch 66 is pivotally attached to the pivot rod 70. As shown in FIG. 11, when the cover latch 66 is pivoted downwards, the indented portion 68 in the housing cover 22 allows for clearance of the handle portion 74. A pulley 78 is disposed on the inner surface of the housing cover 22 below the nozzle fork 52. One end of a cable 80 is fixedly attached to the cam portion 72 of the cover latch 66 and the other end of the cable 80 is fixedly attached to the back portion of the nozzle fork 52. The cable 80 runs from the cam portion 72 to the nozzle fork 52 around the pulley 78. Thus, when the cover latch 66 is pulled downwards, the cable 80 is pulled upwards around the cam portion 72 and downwards around the pulley 78, to thereby provide an overall downward force on the nozzle fork 52 against the biasing force of the spring 62.

Figure 4:
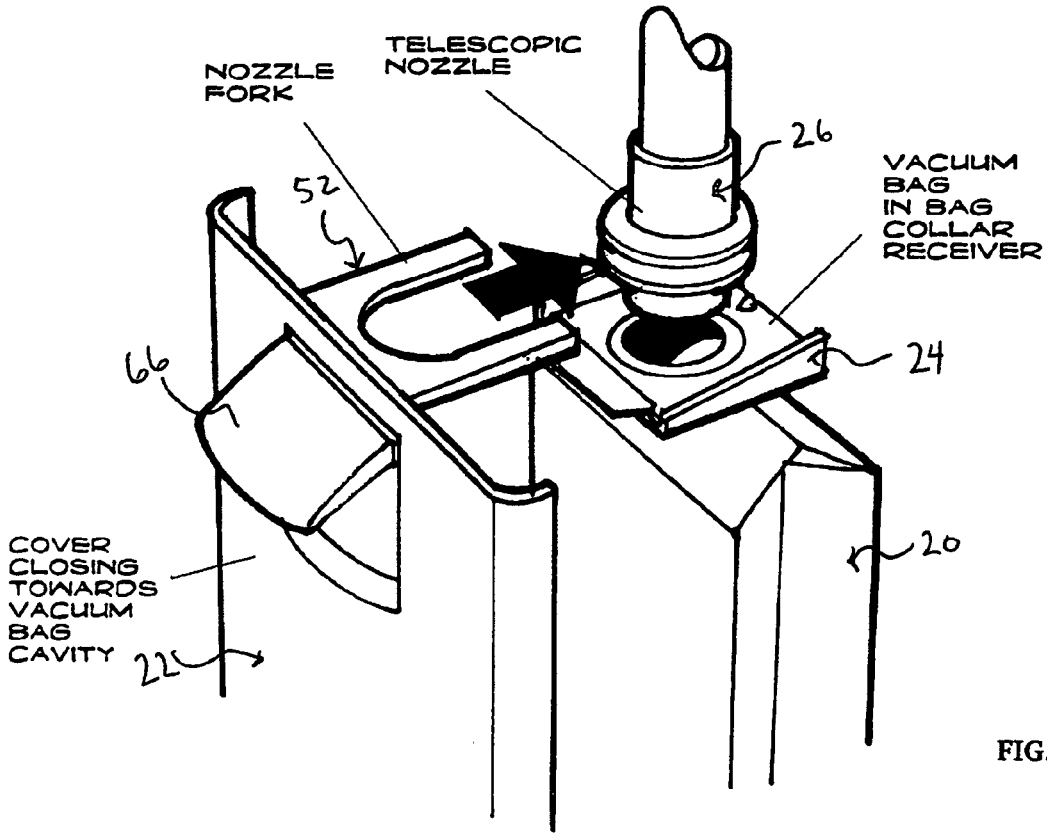
FIG. 4 shows a nozzle fork being engaged with a telescopic nozzle of the vacuum bag housing assembly of FIG. 1.
Figure 5:
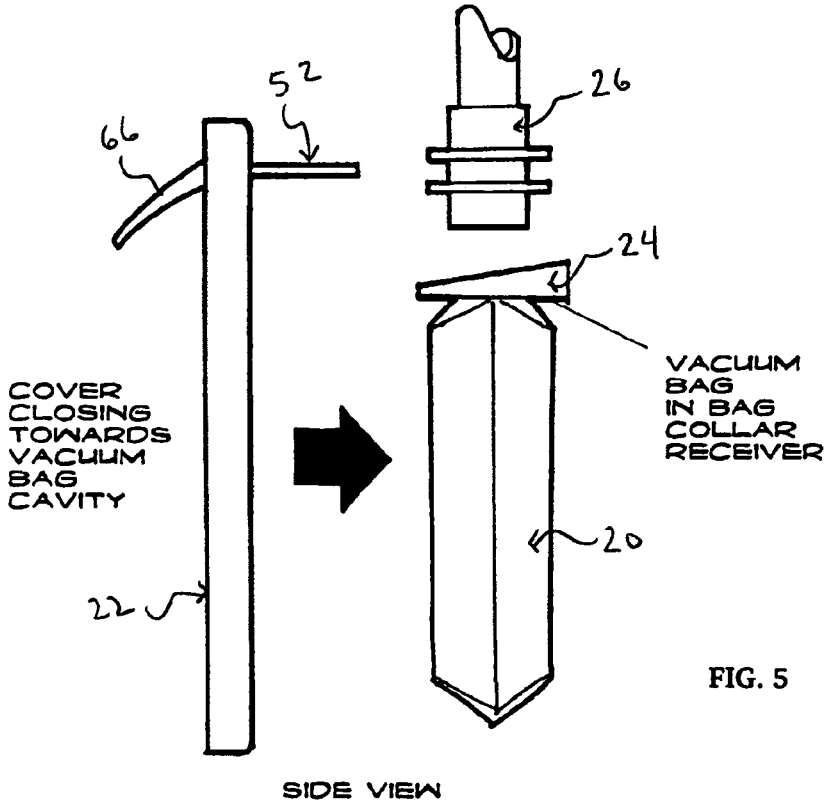
FIG. 5 is a profile view of a nozzle fork being engaged with a telescopic nozzle of the vacuum bag housing assembly of FIG. 1.
Figure 6:
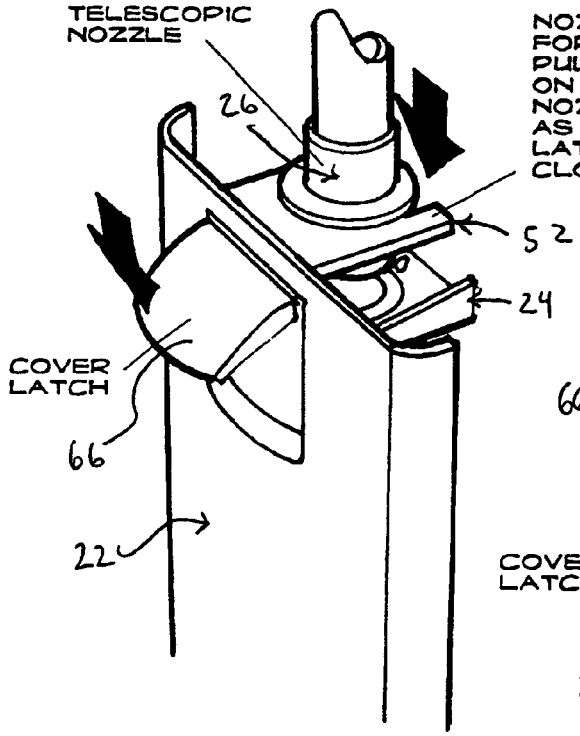
FIGS. 6 and 7 show a cover latch being pivoted downwards to engage a telescopic nozzle of the vacuum bag housing assembly of FIG. 1.
Figure 7:
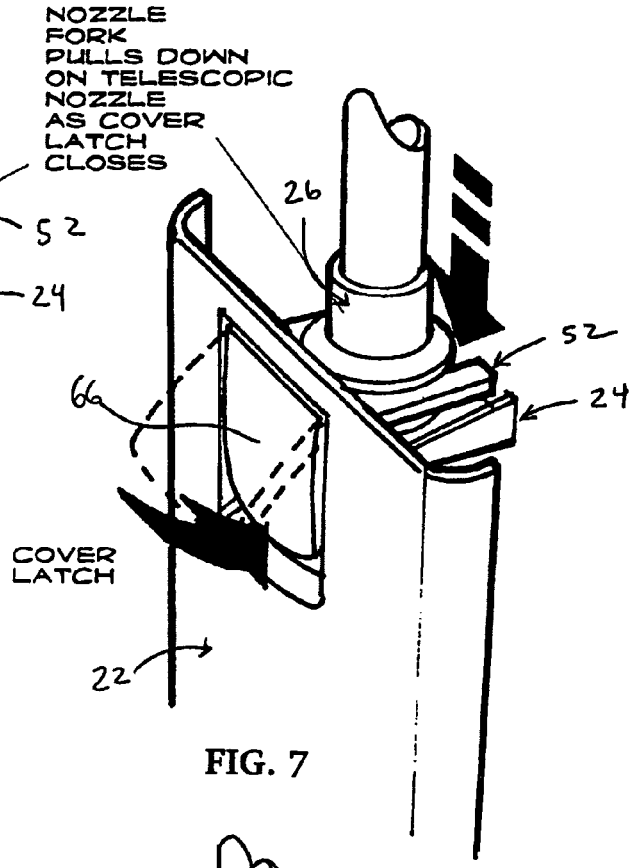
Figure 8:
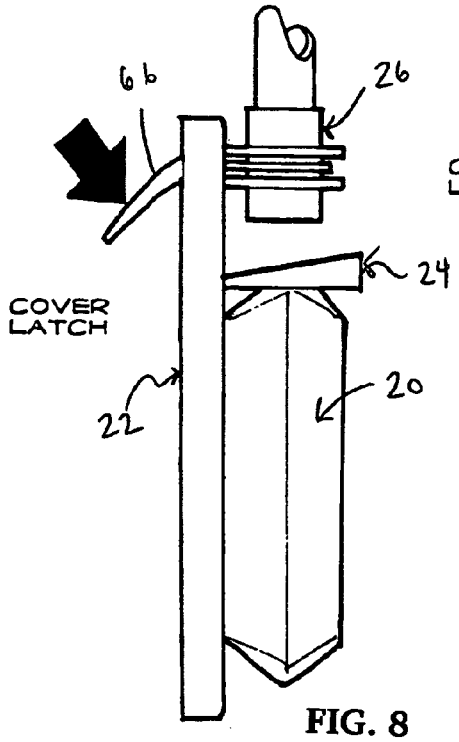
FIGS. 8 and 9 are profile views of a cover latch being pivoted downwards to engage a telescopic nozzle of the vacuum bag housing assembly of FIG. 1.
Figure 9:
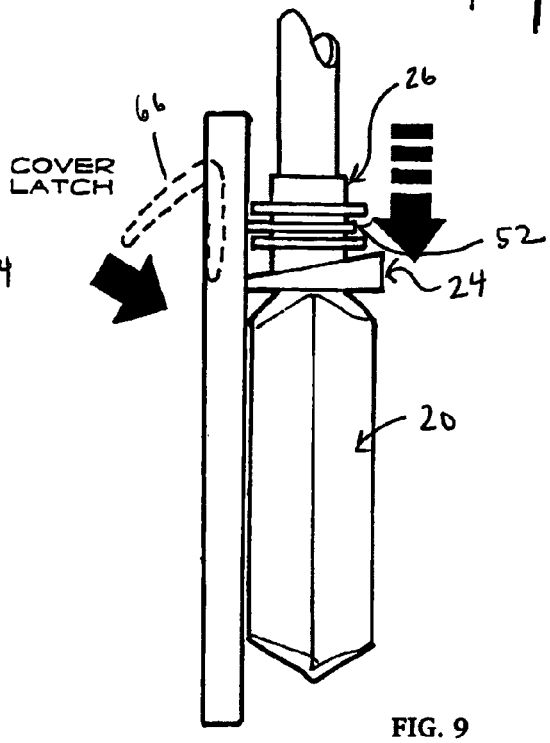

Once the vacuum bag collar 28 is disposed within the bag collar receiver 24, the housing cover 22 can be placed over the storage compartment 18. As shown in FIGS. 4 and 5, as the housing cover 22 is placed over the storage compartment 18, the U-shaped opening 58 in the nozzle fork 52 is slid around the telescopic nozzle end 26, so that the first nozzle fork prong 54 and the second nozzle fork prong 56 are disposed within the circumferential groove 48. The mounting assembly is preferably constructed such that when the telescopic nozzle end 26 is completely retracted, the nozzle fork 52 is vertically aligned with the circumferential groove 48. As shown in FIGS. 6-9, once the nozzle fork 52 is engaged with the telescopic nozzle end 26, the cover latch 66 can be pivoted downwards, which in turn pulls the telescopic nozzle end 26 downwards and in engagement with the collar opening 30. In an exemplary embodiment of the invention, the cover latch 66 may also be used to activate a locking mechanism that locks the housing cover 22 in place over the storage compartment 18.

It should be appreciated that the mechanisms used to move the telescopic nozzle relative to the vacuum bag collar are not limited to those described herein. For example, in another embodiment of the invention, a sliding lever, rather than a pivoting lever, may be used to control the vertical position of the telescopic nozzle.

Figure 12:
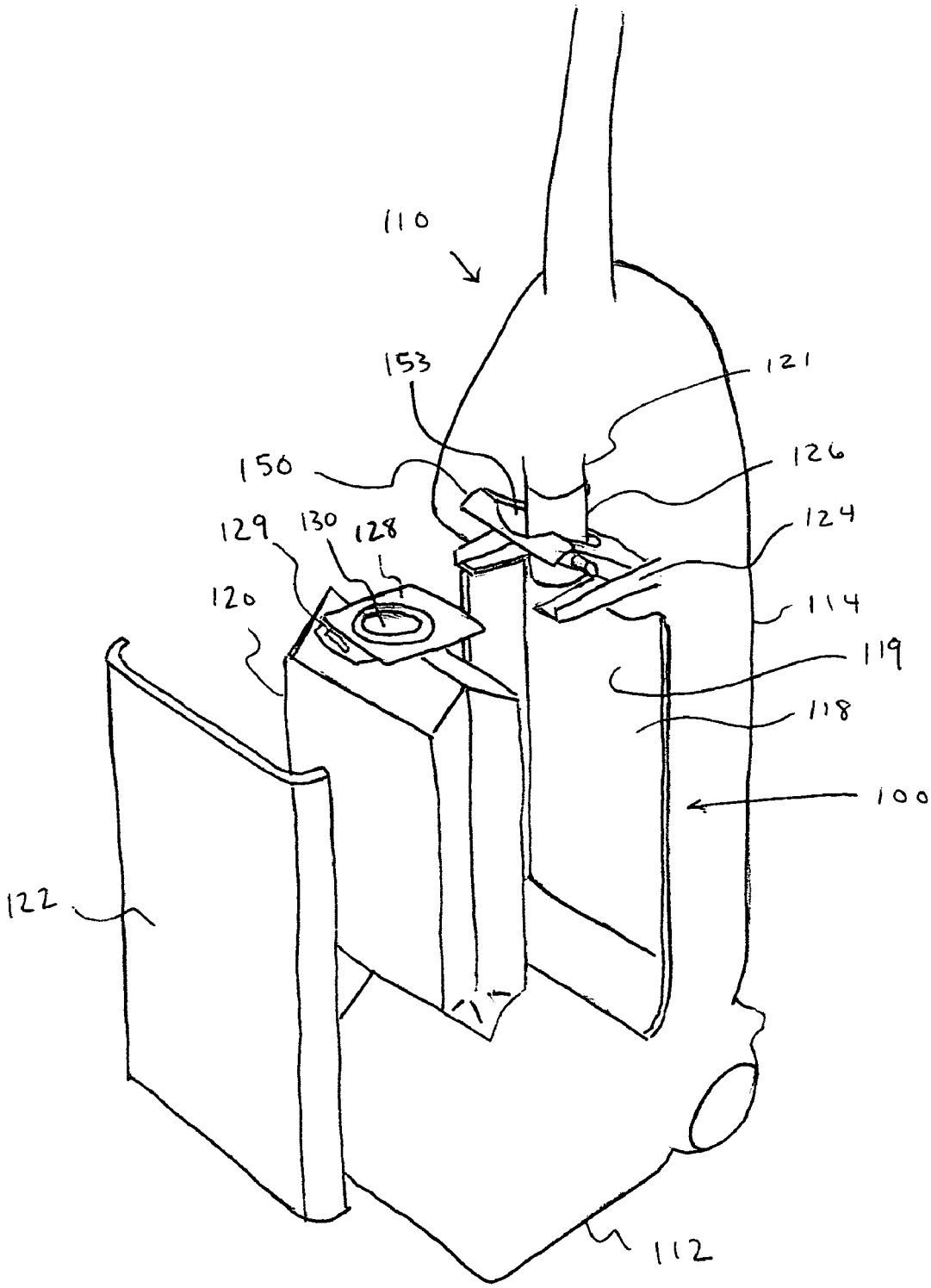
FIG. 12 is an exploded view of a vacuum bag mounting assembly according to another exemplary embodiment of the invention.

FIG. 12 is an exploded view of a vacuum bag mounting assembly, generally designated as reference number 100, according to another exemplary embodiment of the invention. As in the previous embodiment, the mounting assembly 100 includes a vacuum bag storage compartment 118 disposed within a base 114 of a vacuum cleaner 110 for storing a removable vacuum bag 120. A vacuum intake nozzle 121, in communication with the vacuum nozzle head 112 opens into the storage compartment 118. The mounting assembly 100 also includes a housing cover 122 that covers the storage compartment 118, a stationary bag collar receiver 124 that extends outwardly from the back wall 119 of the storage compartment 118 and a telescopic nozzle end 126 that is extendable from the vacuum intake nozzle 121. The housing cover 122 may be removable or hinged to the main body to allow for access to the storage compartment 118. In the present embodiment, as explained more fully below, the housing cover 122 does not include a mechanism, such as the nozzle fork 52 and cover latch 66, for lowering and raising the telescopic nozzle end 102, but instead a nozzle engagement member 150 is pivotally attached to the vacuum bag collar receiver 124 and is manually operable to lower and raise the telescopic nozzle end 102.

Figure 13:
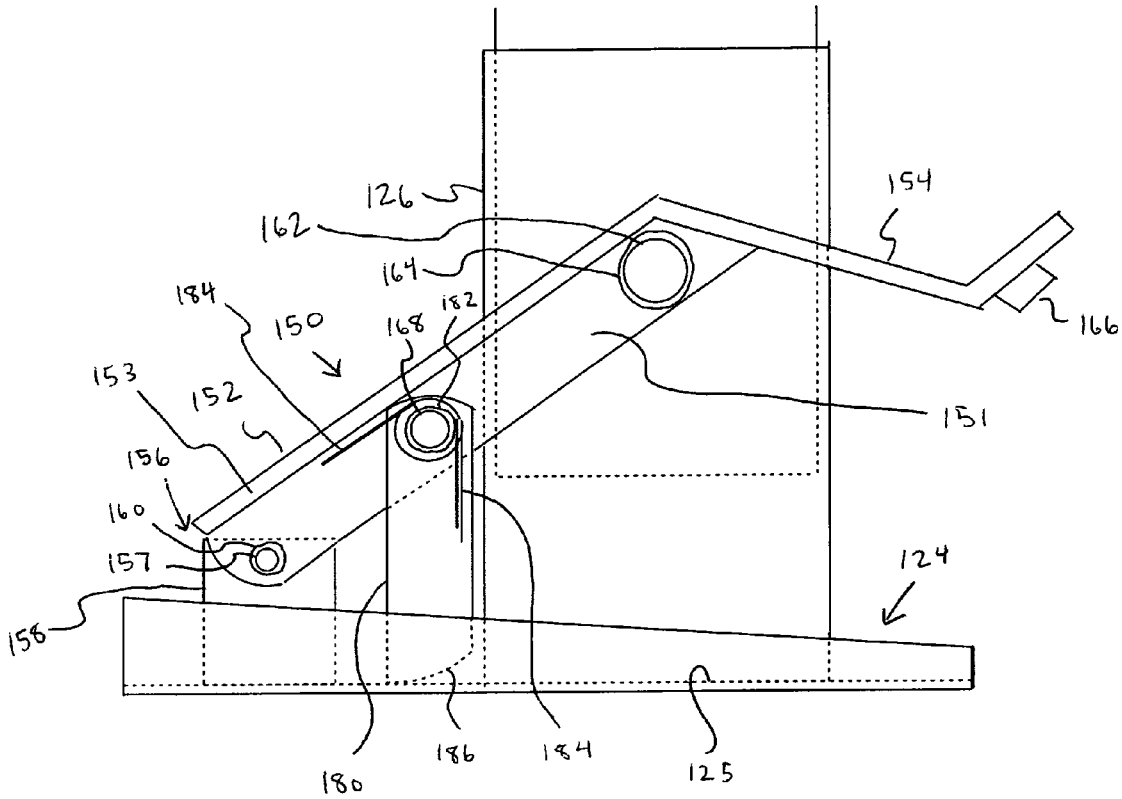
FIG. 13 is a profile view of a vacuum bag collar receiver and a nozzle engagement member of the vacuum bag mounting assembly of FIG. 12.

FIG. 13 is a side view of a portion of the mounting assembly 100 including the nozzle engagement member 150 and the bag collar receiver 124 according to an exemplary embodiment of the invention. The engagement member 150 includes a base portion 152, a latch portion 154 and a nozzle opening 153 through which the telescopic nozzle end 126 extends. The base portion 152 of the engagement member 150 is pivotally attached to the bag collar receiver 124 through a pivot means 156. The first pivot means 156 may include pivot pins 157 (the second pivot pint is not shown in FIG. 13), that extend from either the base portion 152 or a hinge base 158, that interact with a corresponding through-hole 160 in either the base portion 152 or the hinge base 158. It should be appreciated that the pivot means 156 is not limited to these components, and may include any other combination of components that allow the engagement member 150 to pivot in relation to the bag collar receiver 124, such as a pivot pin that extends completely across with width of the base portion 152. The base portion 152 is also pivotally attached to the telescopic nozzle end 126, preferably through pivot pins 162 that extend from opposite sides of the telescopic nozzle end 126 and that extend through pivot holes 164 formed in side walls 151 of the base portion 152.

The latch portion 154 extends at an angle from the base portion 152, and includes a latch element 166. As explained in further detail below, the latch element 166 latches to the vacuum bag collar 128 to lock the vacuum bag 120 in position within the storage compartment 118.

As shown in FIG. 13, a pair of catch members 180 locks the nozzle engagement member 150 in the up position. One end of each catch member 180 is pivotally attached to the base portion 152 of the nozzle engagement member 150, preferably though pivot pins 168 that extend from the side walls 151 of the base portion 152 through pivot holes 182 formed in the catch members 180. Each catch member 180 is biased in the vertical position by a torsion spring 184, one end of which is urged by spring forces into engagement with an extending portion 153 of the base portion 152 and the other end of which is urged by spring forces into engagement with an extending portion 184 of the catch member 180. The opposite end of each catch member 180 includes a rounded surface 186 that is frictionally engaged with a bottom wall 125 of the bag collar receiver 124.

Figure 14A:
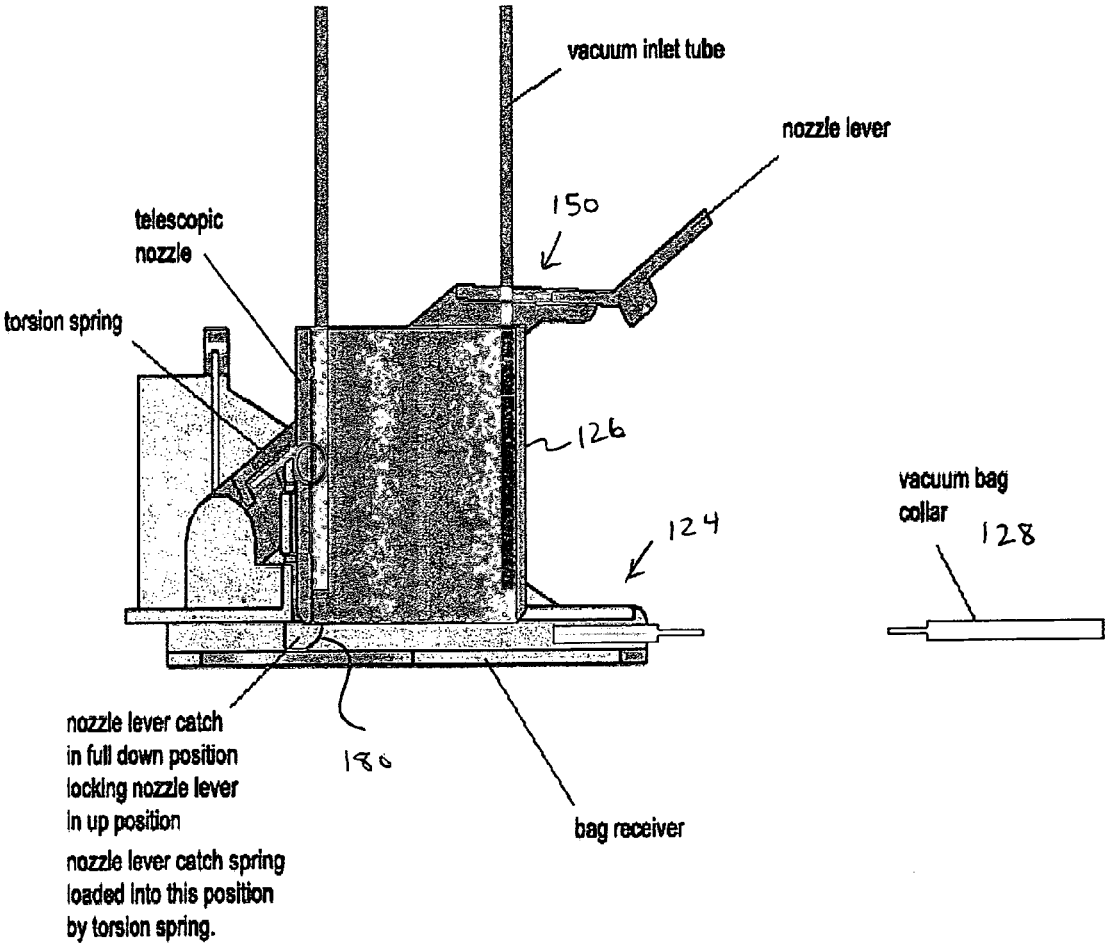
FIGS. 14A-D show a vacuum bag collar being inserted into the vacuum bag collar receiver of the vacuum bag mounting assembly of FIG. 12.
Figure 14B:
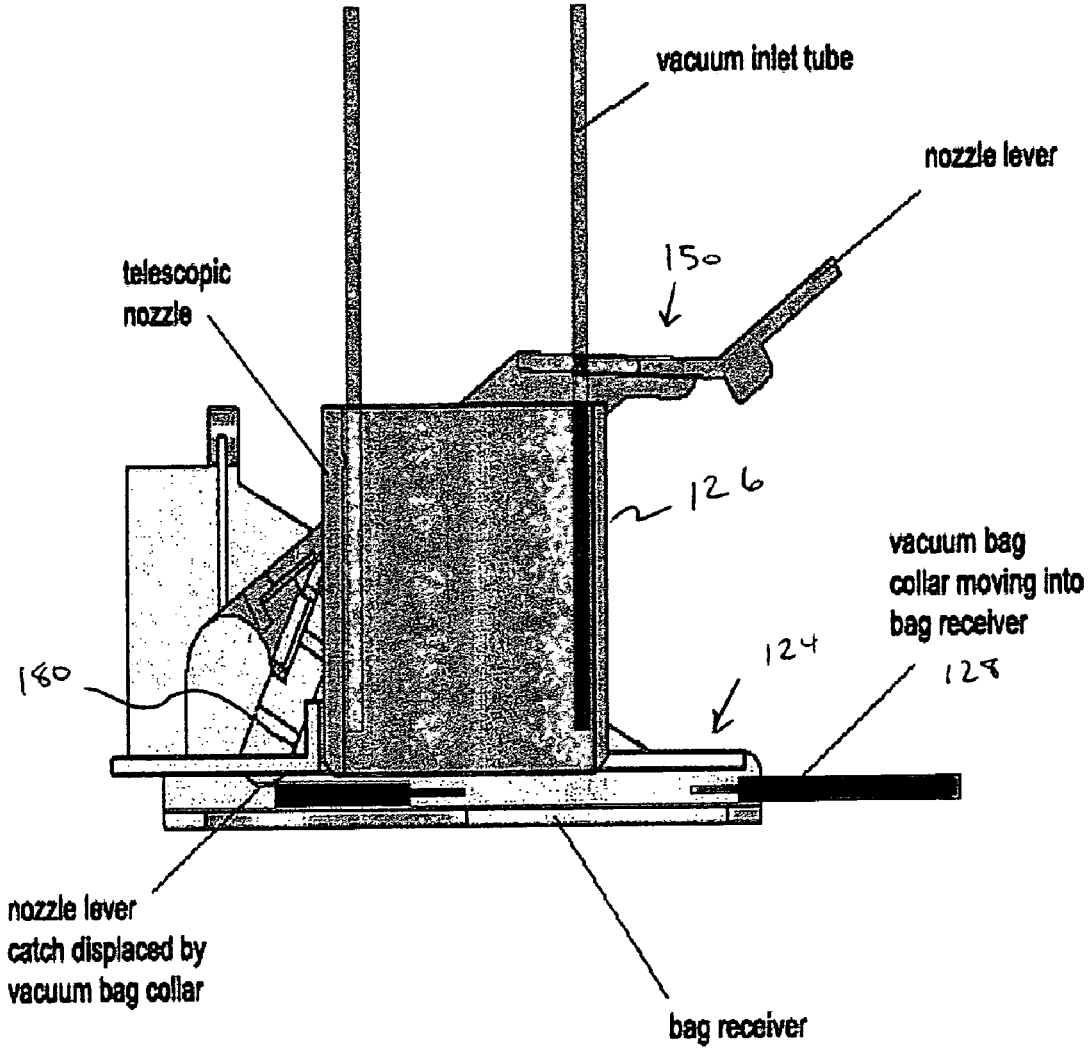
Figure 14C:
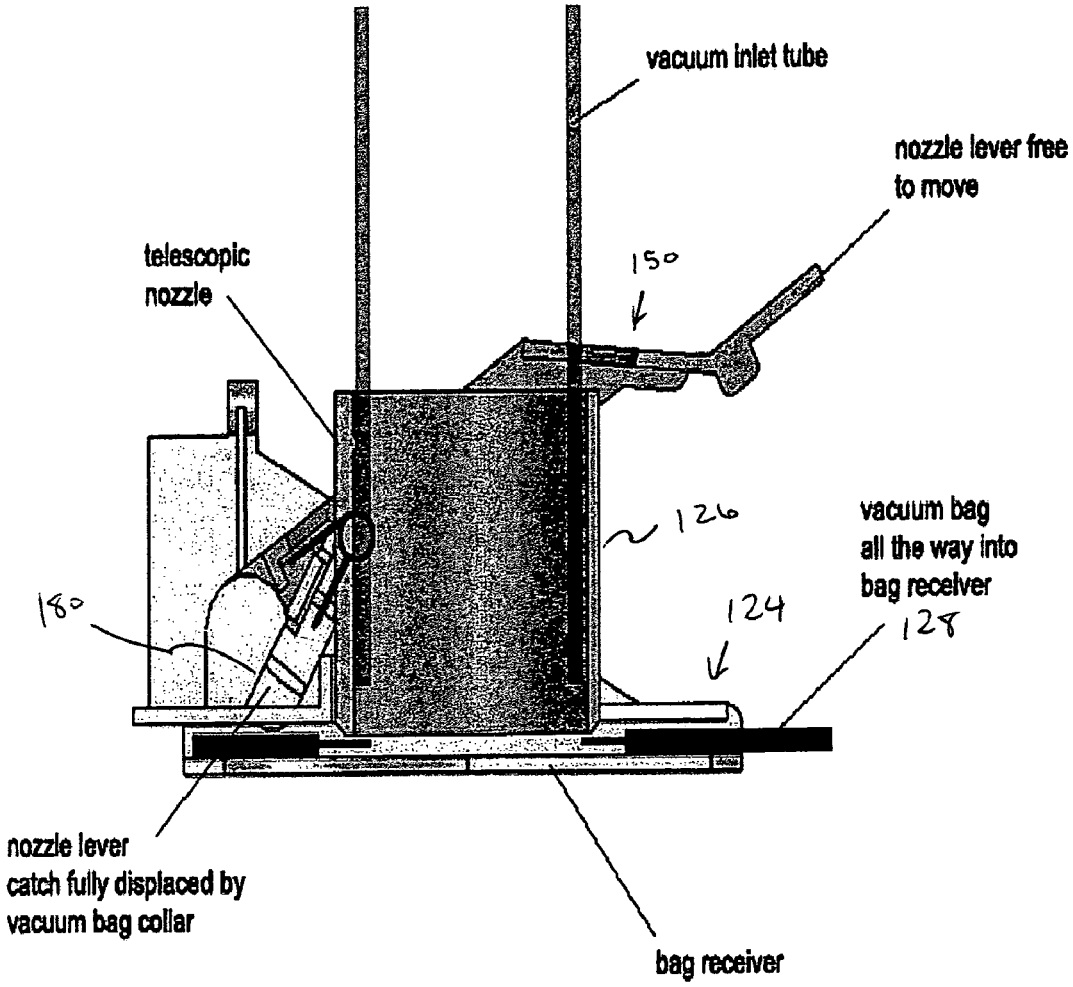
Figure 14D:
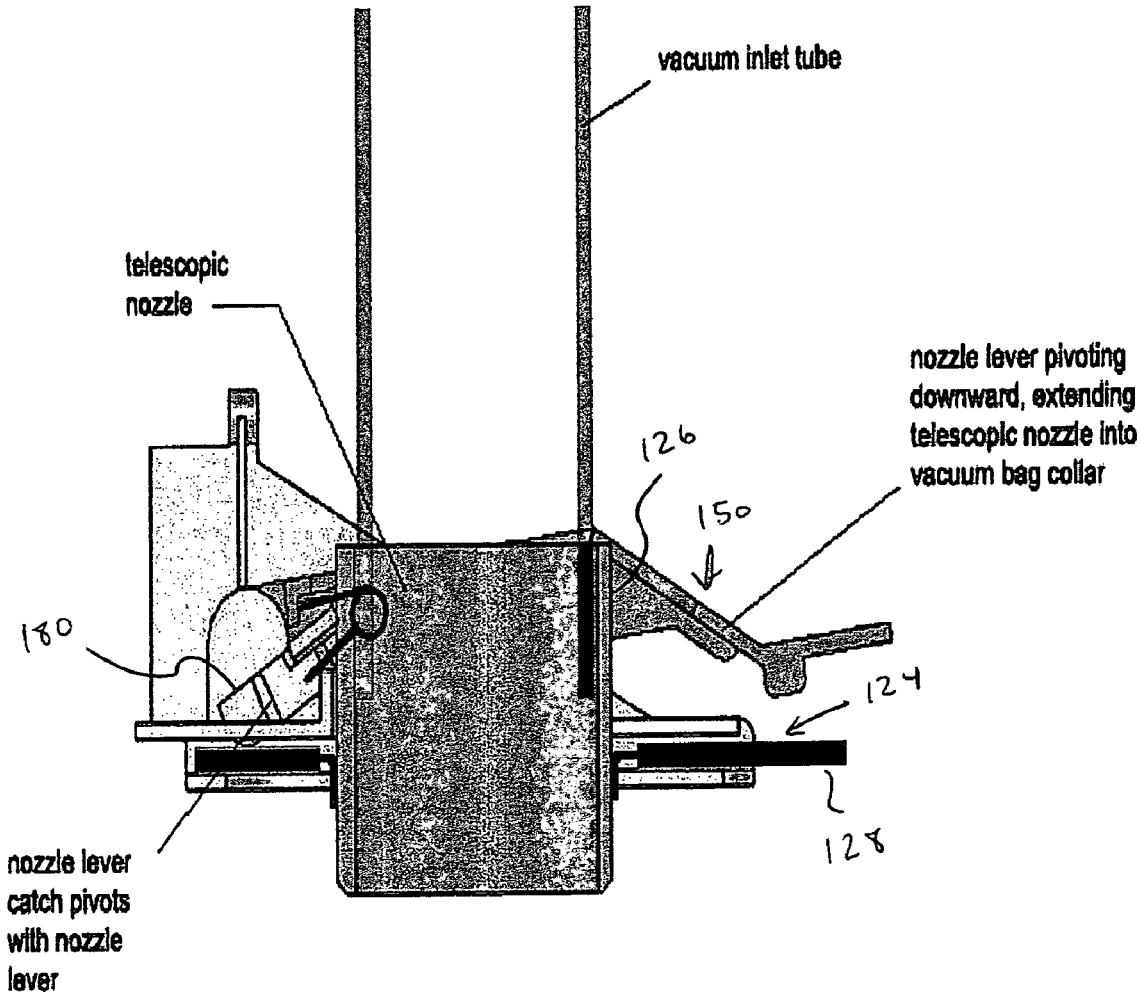
Figure 15:
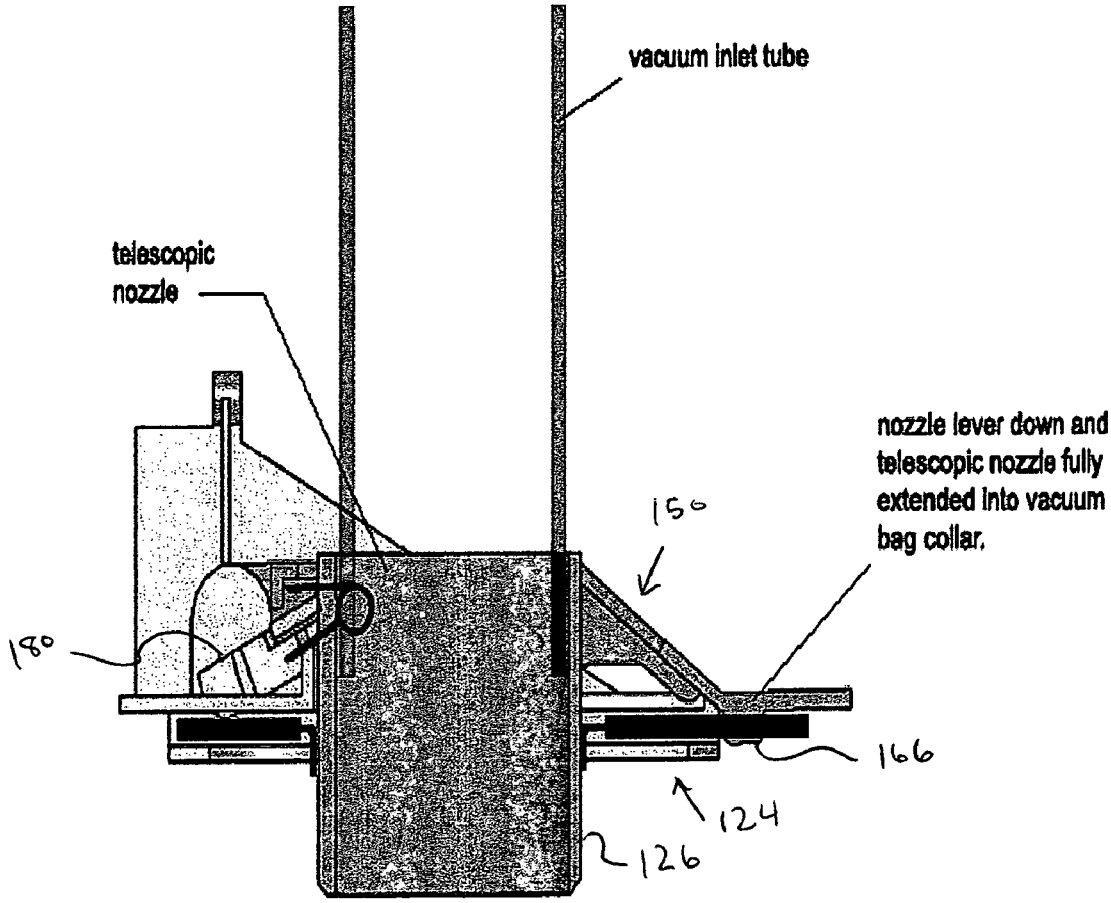
FIG. 15 shows the nozzle engagement member latched to the vacuum bag collar receiver of the vacuum bag mounting assembly of FIG. 12.

As shown in FIGS. 14A-D, the nozzle engagement member 150 is pivoted downwards as the vacuum bag collar 128 is slid into the bag collar receiver 124. In particular, the vacuum bag collar 128 engages the rounded surface 186 of the catch member 180 (FIG. 14B), and then urges the catch member 180 back against the bias force of the torsion spring 184 (FIGS. 14C-D). Because the catch member 180 is pivotally attached to the nozzle engagement member 150, as the catch member 180 is urged backwards by the vacuum bag collar 128, it pulls the nozzle engagement member 150 downwards, which in turn pulls the telescopic nozzle end 126 downwards through the collar opening 130. Once the nozzle engagement member 150 is in the position shown in FIG. 14D, it can be manually pulled further downwards so that the latch element 166 engages with a locking hole 129 formed in the vacuum bag collar 128 by a snap-fit.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A vacuum bag mounting assembly for housing a vacuum bag within a vacuum cleaner, the vacuum cleaner comprising a vacuum intake nozzle having an outlet end portion through which sucked in dirt is delivered to the vacuum bag mounting assembly, the vacuum bag mounting assembly comprising:

a vacuum bag collar receiver that engages a collar of the vacuum bag;

a telescopic nozzle end attached to the outlet end portion, the telescopic nozzle end being moveable along the outlet end portion towards and away from the collar of the vacuum bag; and a nozzle engagement member pivotally attached to the vacuum bag collar receiver, the nozzle engagement member being attached to the telescopic nozzle end such that pivoting of the nozzle engagement member in a first direction results in movement of the telescopic nozzle end away from the collar of the vacuum bag and pivoting of the nozzle engagement member in a second direction results in movement of the telescopic nozzle end towards the collar of the vacuum bag.

2. The vacuum bag mounting assembly of claim 1, further comprising a latch member, the latch member comprising:

a first end pivotally attached to the nozzle engagement member;

a second end frictionally engaged with a bottom wall of the vacuum bag collar receiver; and a torsion spring that provides a spring force that biases the latch mechanism in a vertical position, wherein the vacuum bag collar contacts the second end of the latch member as the vacuum bag collar is inserted into the vacuum bag collar receiver to thereby urge the latch member against the spring force such that the nozzle engagement member is pivoted in the second direction.

3. The vacuum bag mounting assembly of claim 1, wherein the nozzle engagement member further comprises a first latch element that locks into a second latch element formed in the vacuum bag collar.

4. The vacuum bag mounting assembly of claim 1, wherein the vacuum bag collar receiver comprises a U-shaped opening for engagement with the vacuum bag collar.

5. The vacuum bag mounting assembly of claim 1, wherein the telescopic nozzle end comprises pivot pins that engage with through-holes formed in the nozzle engagement member.

6. A vacuum cleaner comprising the vacuum bag mounting assembly of claim 1.

7. A vacuum cleaner comprising:

a vacuum nozzle head;

a handle for maneuvering the vacuum cleaner;

a vacuum bag mounting assembly for holding a vacuum bag; and a vacuum intake nozzle having an outlet end portion through which sucked in dirt is delivered to the vacuum bag housing assembly, wherein the vacuum bag mounting assembly comprises:

a vacuum bag collar receiver that engages a collar of the vacuum bag;

a telescopic nozzle end attached to the outlet end portion, the telescopic nozzle end being moveable along the outlet end portion towards and away from the collar of the vacuum bag; and a nozzle engagement member pivotally attached to the vacuum bag collar receiver, the nozzle engagement member being attached to the telescopic nozzle end such that pivoting of the nozzle engagement member in a first direction results in movement of the telescopic nozzle end away from the collar of the vacuum bag and pivoting of the nozzle engagement member in a second direction results in movement of the telescopic nozzle end towards the collar of the vacuum bag.

8. The vacuum cleaner of claim 7, wherein the vacuum bag mounting assembly further comprises a latch member, the latch member comprising:

a first end pivotally attached to the nozzle engagement member;

a second end frictionally engaged with a bottom wall of the vacuum bag collar receiver; and a torsion spring that provides a spring force that biases the latch mechanism in a vertical position, wherein the vacuum bag collar contacts the second end of the latch member as the vacuum bag collar is inserted into the vacuum bag collar receiver to thereby urge the latch member against the spring force such that the nozzle engagement member is pivoted in the second direction.

9. The vacuum bag housing assembly of claim 7, wherein the nozzle engagement member further comprises a first latch element that locks into a second latch element formed in the vacuum bag collar.

10. The vacuum bag mounting assembly of claim 7, wherein the vacuum bag collar receiver comprises a U-shaped opening for engagement with the vacuum bag collar.

11. The vacuum bad mounting assembly of claim 7, wherein the telescopic nozzle end comprises pivot pins that engage with through-holes formed in the nozzle engagement member.

* * * * *